United States Patent [19]

Duvall

[11] 4,432,525

[45] Feb. 21, 1984

[54] ADJUSTABLE CHAIR SUPPORT

[76] Inventor: Clarence E. Duvall, 2614 N. Wilson Dr., Peoria, Ill. 61604

[21] Appl. No.: 333,642

[22] Filed: Dec. 23, 1981

[51] Int. Cl.[3] ..... F16M 13/00

[52] U.S. Cl. ..... 248/430; 114/363; 248/226.1; 248/287; 297/252; 297/314

[58] Field of Search ..... 248/430, 424, 429, 231.4, 248/657, 316.6, 172, 287; 114/363; 297/230, 252, 314

[56] References Cited

U.S. PATENT DOCUMENTS

| | | | |
|---|---|---|---|
| 734,919 | 7/1903 | Mast . | |
| 821,704 | 5/1906 | Conway . | |
| 1,535,779 | 4/1925 | Johnston | 248/172 |
| 2,308,315 | 1/1943 | Smith | 297/252 |
| 2,324,207 | 7/1943 | Gsell | 155/14 |
| 2,681,690 | 6/1954 | Johnson . | |
| 2,725,092 | 11/1955 | Cartwright . | |
| 3,113,804 | 12/1963 | Ritter | 297/252 |
| 3,598,355 | 8/1971 | Bryan English | 248/430 |
| 3,718,365 | 2/1973 | Gibson | 114/363 X |
| 3,889,913 | 6/1975 | Adams | 248/430 |
| 3,891,269 | 6/1975 | Moeser | 297/252 |
| 3,961,765 | 6/1976 | Brothers | 248/231.4 X |
| 4,004,772 | 1/1977 | Pickles | 248/430 |
| 4,109,973 | 8/1978 | Terada | 308/3 R |
| 4,210,303 | 7/1980 | Torta et al. | 248/429 |

FOREIGN PATENT DOCUMENTS

| | | | |
|---|---|---|---|
| 637219 | 5/1950 | United Kingdom | 248/430 |

*Primary Examiner*—J. Franklin Foss
*Assistant Examiner*—David L. Talbott
*Attorney, Agent, or Firm*—McCaleb, Lucas & Brugman

[57] ABSTRACT

Adjustable device to support a chair on a boat seat enabling the chair to be moved sidewise and locked either in a center position or selected offcenter positions on both sides. A wheeled carriage, with bolts connecting it to a swivelable chair, is movable from side to side along a floor plate in an elongated body which is fastened lengthwise by clamps on a boat seat bench or thwart. A manually movable spring-loaded latch pin mounted on the carriage is selectively engageable in any one of a plurality of apertures in the floor plate to lock the carriage in a center position or a selected offcenter position. The clamps are adjustable to accommodate seat benches of different vertical thicknesses and different fore-and-aft depths. A concealed space is provided within the lower part of the body for threaded clamp adjustment members.

7 Claims, 7 Drawing Figures

34
124
122
136
132
32
60
59
50
72
52
126
66
84
84
90
90
82
82
82
86

82
32
50
118
40
118
4.
48
48
60
62
5.
50
120
110
122
138
138
138
98
6.
6.
42
126
64
120
59
118
118
46
96
60
62
5.
96
86
82
84
4.
84
82

34
112
54
124
122
32
54
40
46
80
118
50
110
118
36
48
52
52
120
120
72
74
59
76
66
56
58
94
64
94
58
56
66
38
84
78
24
84
92
94
96
92
68
70
98
88
98
70
44
82
24
104
D
90
90
H
100
86
108
102
106
102
108

ADJUSTABLE CHAIR SUPPORT

BACKGROUND OF THE INVENTION

This invention relates generally to chairs which need to be moved sidewise from time to time. An example described here to illustrate one application of the invention is a chair used by a fisherman and mounted on a rear boat seat bench or thwart. For fishing, the chair should be centered for proper balance and to facilitate fishing from both sides of the boat. For operating an outboard motor, however, the fisherman must move to one side so he can reach the motor controls and operates the steering tiller which are centered at the stern.

While comfortable chairs, some complete with tiltable backs, upholstery, and swivel bases, are marketed with clamps for mounting them on boat seat benches or thwarts, they have heretofore been limited to use on forward or intermediate seat benches. Prior to the present invention, such a chair has not been used on the rear seat because, if clamped in the middle for fishing, it would interfere with operating the motor and tiller. No apparatus has been available to readily shift such a chair sidewise between locked center and offcenter positions.

SUMMARY OF THE INVENTION

Therefore, it is a general object of the present invention to provide an adjustable mounting device enabling sidewise movement of a chair along a seat bench or other support so the chair can be locked and used in a plurality of transversely shifted, fixed positions. While advantageous for use on boats, the invention is not limited to that particular use.

Another object is to provide such a device which can readily be clamped on and removed from a seat or bench as needed.

Another object is to provide such a device having clamps which are readily adjustable for different thicknesses and depths of seat benches.

Another object is to provide an adjustable chair support device for boats and other applications comprising an elongated body adapted to be mounted on the top of a seat bench, a chair-supporting carriage movable sidewise along a floor plate in the body, clamps for mounting the body on the seat bench adjustable for different heights and depths of seats, and a manually operable latch pin on the carriage engageable with a selected one of a plurality of detent openings in the body to lock the carriage in a center or offcenter position as selected.

Another object is to provide the carriage with wheels bearing on the floor plate and a pair of upstanding guide rails on the floor plate engaging the wheels to guide the carriage for movement in a substantially straight line without rubbing against the body.

Another object is to provide at least two clamps on the front or back sides of the body symmetrically disposed with respect to the center of the body, and at least one clamp on the opposite side to achieve a stable, three-point connection between the body and the seat bench.

Another object is to provide brackets on the clamps which engage the lower corners of a seat bench to restrain the body from both vertical and horizontal movements.

Another object is to provide horizontal threaded connections between the clamps and body within a concealed space in the latter to adjust the clamps to different depth seat benches, and to provide vertical threaded connections between the clamps and brackets to accommodate different height seat benches.

BRIEF DESCRIPTION OF THE DRAWINGS

Other objects and advantages will be apparent from the following description taken in connection with the accompanying drawings in which.

Like parts are referred to by like reference characters.

DESCRIPTION OF THE PREFERRED EMBODIMENT

Figure 1:
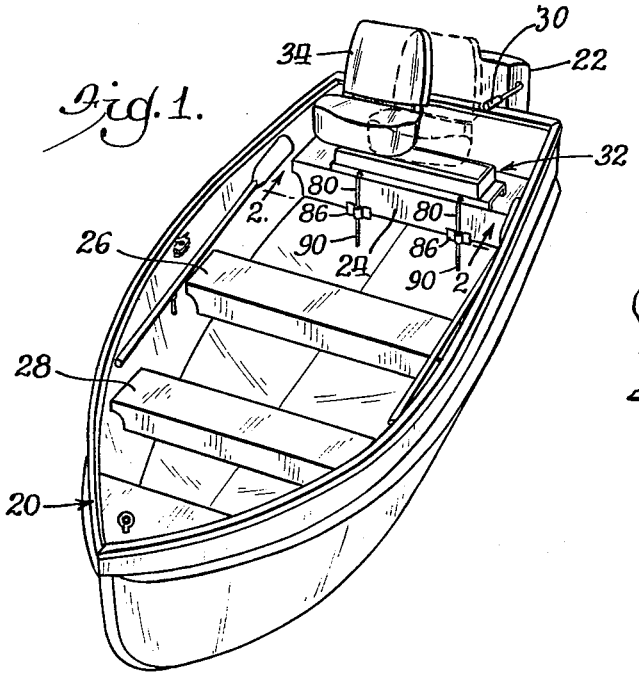
FIG. 1 is a perspective view of a typical fishing boat showing one application of the present invention.

Referring now to the specific embodiment of the invention shown in the drawings, FIG. 1 illustrates a typical boat 20 fitted with an outboard motor 22 which may be used in recreation or fishing and showing one application of the present invention. It has rear, intermediate, and forward seat benches or thwarts 24, 26 and 28, respectively. Normally, the rear seat bench 24 is occupied by the person operating the motor 22. From there, the motor controls and tiller handle 30 are within easy reach when the operator is seated far over to the side.

The adjustable chair support device of the present invention is generally designated 32. It is clamped to the rear seat bench 24 and supports a comfortable, cushioned chair 34 for sidewise movement between a plurality of fixed positions, two of which are shown in solid and broken lines in FIG. 1.

Device 32 comprises an elongated body 36, clamp means 38, a carriage 40, and latch means 42.

Figure 2:
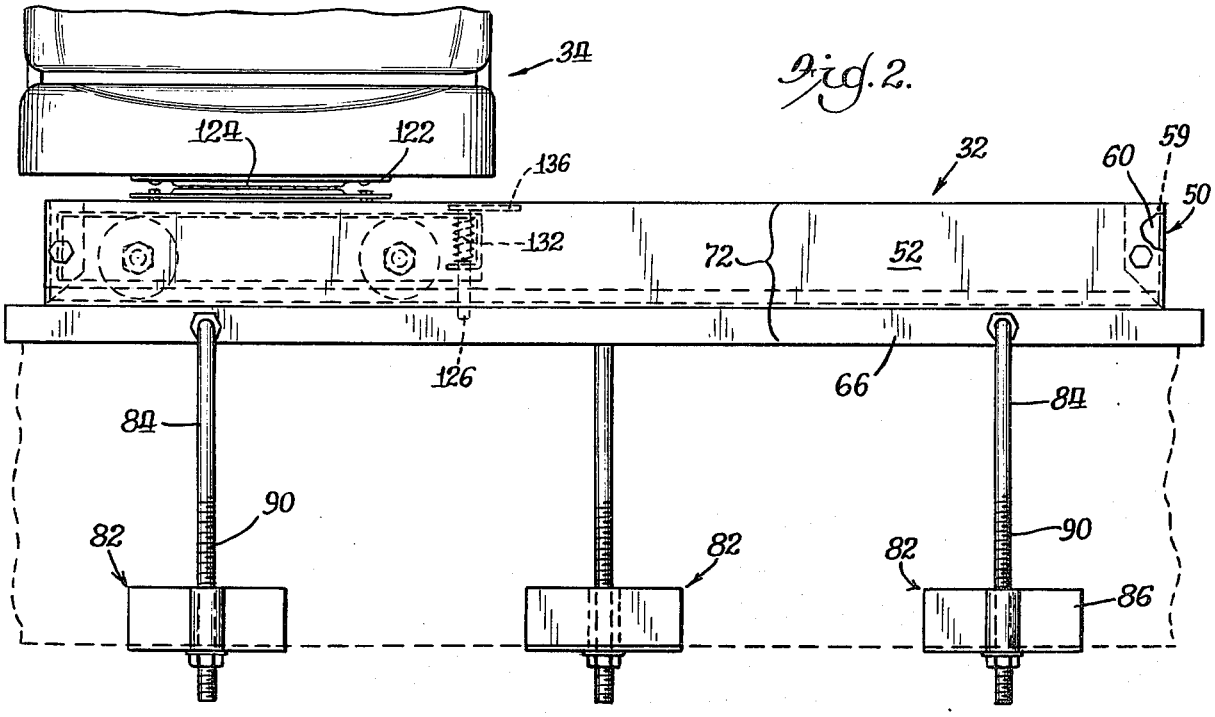
FIG. 2 is an enlarged front view of the invention seen generally in the direction of the arrows 2—2 in FIG. 1 but without the boat seat bench.
Figure 3:
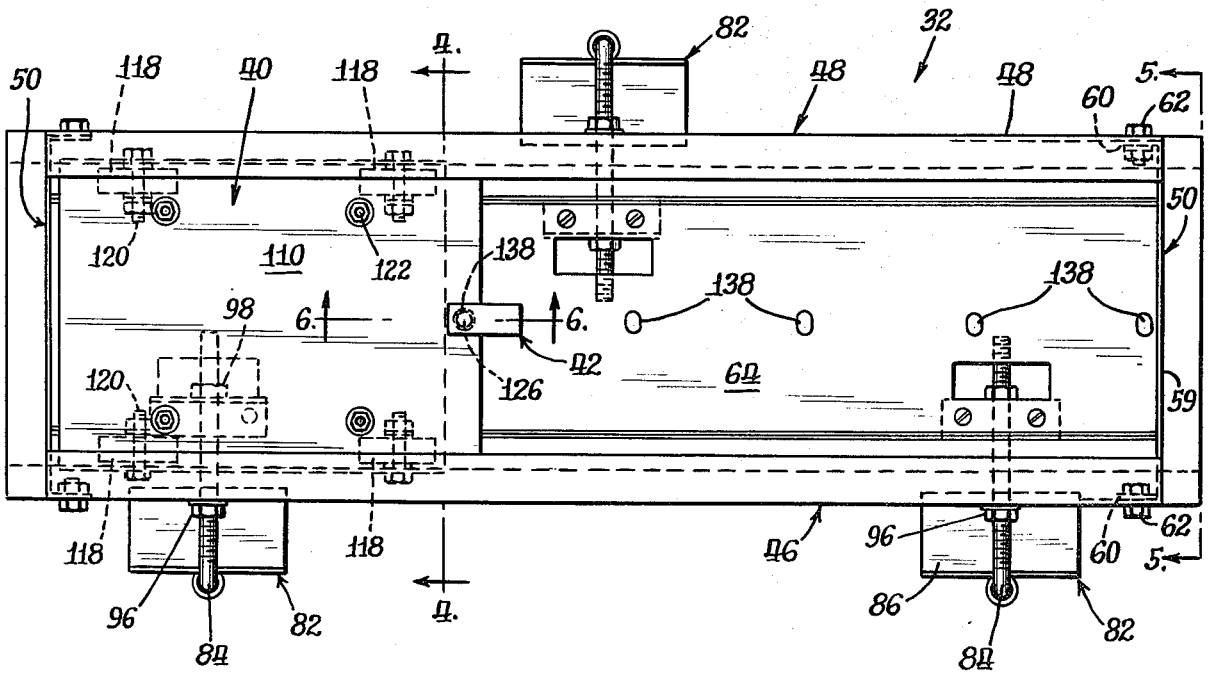
FIG. 3 is a plan view of FIG. 2.
Figure 4:
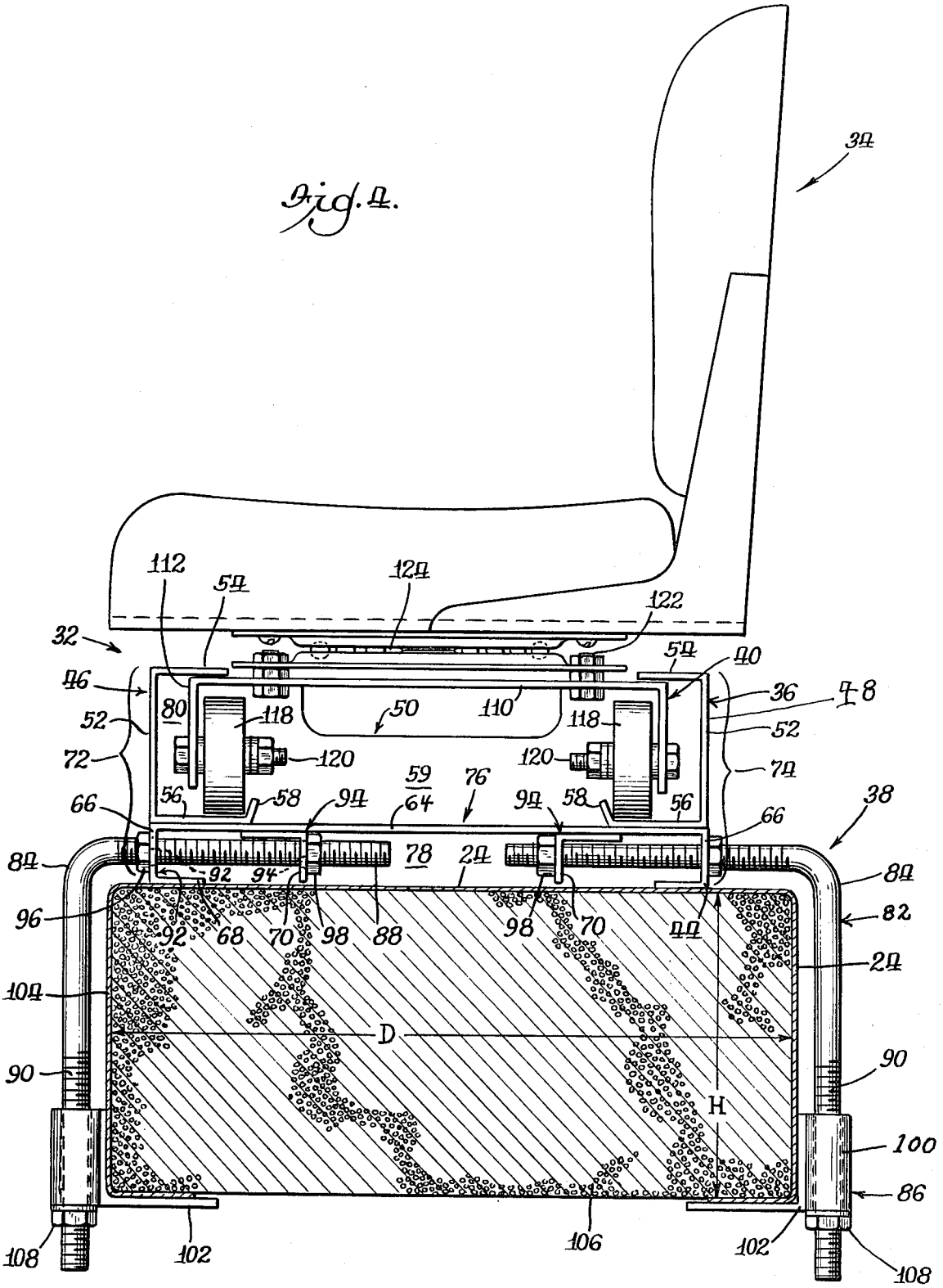
FIG. 4 is a vertical cross-sectional view taken along line 4—4 of FIG. 3 with a cross-section of the boat seat bench.

As shown in FIGS. 3 and 4, the body 36 comprises a hollow, lower base 44, a pair of front and back upper channels 46 and 48 respectively, and opposite end walls 50, 50. In addition to providing cross connections to rigidify the body, the end walls 50 function as stops for the carriage at both ends of its travel. Each of the channels 46 and 48 consists of a vertical web 52 with upper and lower inwardly extending horizontal flanges 54 and 56 respectively. The lower flanges 56 have upstanding parallel guide rails 58, 58 to guide the carriage for movement in a straight line as will be described. As best shown in FIGS. 2 and 3, each end wall 50 comprises a vertical web 59 and a pair of inwardly extending vertical flanges 60, 60 fastened by bolts 62 between the webs 52.

The hollow base 44 comprises a horizontal floor plate 64, downturned vertical walls 66, 66, and inwardly extending lower horizontal flanges 68, 68. A plurality of braces 70, illustrated as short sections of angle members affixed as by welding beneath the plate 64, are spaced inwardly from the front and back walls 46 and 48 and are aligned with individual clamps of the clamp means 38 to provide auxiliary support for the clamps as will be described.

Thus, viewing the construction broadly, the body 36 comprises a front wall 72 consisting of vertically aligned sections 52 and 66; a rear wall 74 likewise consisting of vertically aligned sections 52 and 66; and floor plate means 76 consisting of floor plate 64 and lower flange portions 56, 56 of channels 46 and 48. Spaced parallel guide rails 58, 58 extend upwardly, and braces 70, 70 extend downwardly, from floor plate means 76.

Figure 6:
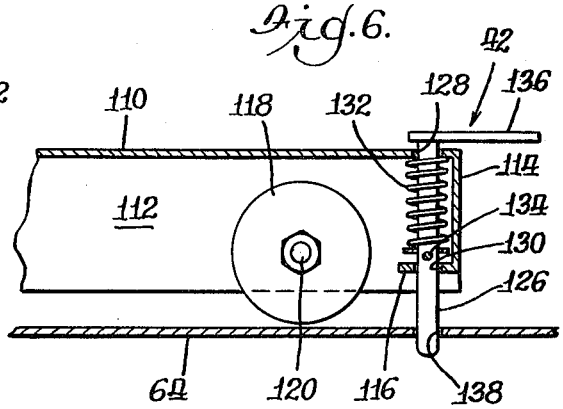
FIG. 6 is a fragmentary-sectional view of FIG. 3 taken along the line 6—6.
Figure 5:
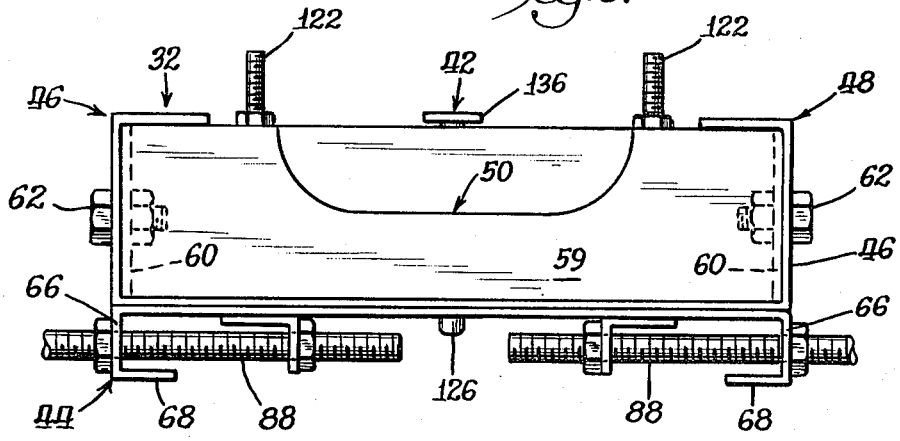
FIG. 5 is a fragmentary end view of FIG. 3 as seen in the direction of the arrows 5—5.
Figure 7:
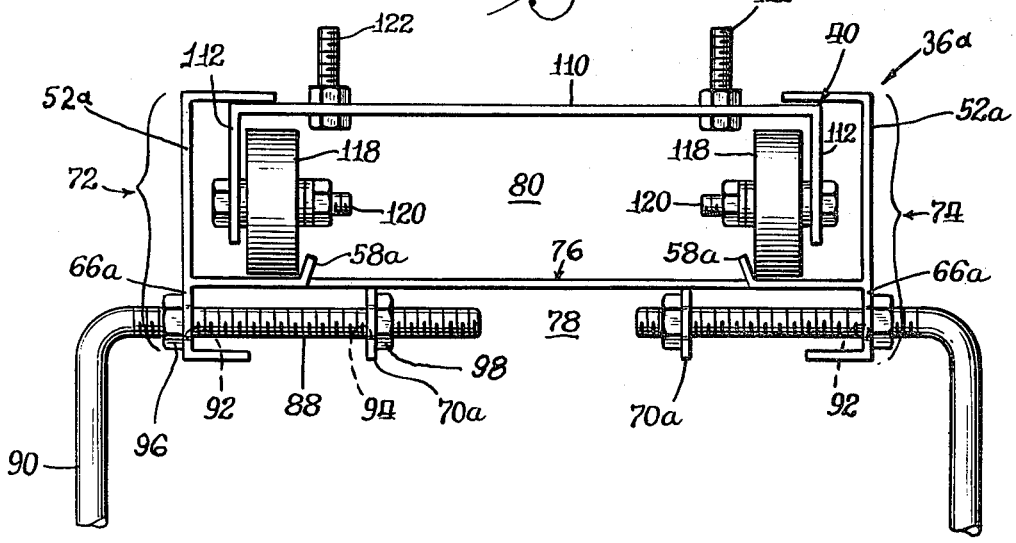
FIG. 7 is a fragmentary, cross-sectional view similar to FIG. 4, without the boat seat bench, showing an equivalent, slightly modified version of the invention.

FIG. 7 shows an equivalent, slightly modified form of body which, to distinguish it from body 36, is designated 36*a*. The construction is fabricated or cast integral instead of being made up of separate components as shown in FIGS. 1–6. Each of the front and rear walls 72 and 74 comprises integral wall sections 52*a* and 66*a*. The floor plate means 76 is a single plate instead of the combination of plate 64 and flanges 56, 56 shown in FIG. 4. The upstanding guide rails 58*a* are integral with the floor plate means 76 instead of being turned-up ends of flanges 56, 56 as shown in FIG. 4. And the depending braces 70*a* are integral with the floor plate means 76 instead of being separate angle sections as shown in FIG. 4.

Thus, the horizontal floor plate means 76, whether fabricated as shown in FIG. 4 or in FIG. 7, is interconnected between the front and back walls 72, 74 at a location which is vertically intermediate the tops and bottoms thereof to provide a lower space 78 and an upper space 80 respectively below and above the floor plate means 76.

As best shown in FIGS. 2, 3 and 4, the clamp means 38 comprises a plurality, in this case, three, individual clamps 82. Each includes a right angled rod 84 and a corner engaging saddle member 86. Each rod 84 has horizontal and vertical threaded legs 88 and 90 respectively. Two of the clamps 82 are located at the front of the body, equally spaced symmetrically with respect to the center, and a single clamp 82 is centrally positioned at the back. The three clamps are best shown in FIG. 3.

As best shown in FIGS. 4 and 7, each clamp horizontal leg 88 extends through an opening 92 in one of the front or back walls 72 and 74, and through another opening 94 in one of the braces 70 or 70*a*. Threaded nuts 96 and 98 hold the clamp rods in fixed horizontal adjustment. These nuts and horizontal legs of the adjustment rods and braces 70/70*a* are effectively concealed within the lower space 78 beneath the floor plate.

Each saddle member 86 includes a tubular section 100 through which the vertical leg 90 extends and a right angle section 102 shaped to grip the lower corners of the seat bench 24. The seat bench, as shown, is of conventional construction comprising an aluminum shell 104 with a fore-and-aft depth D and vertical height H filled with flotation material 106. Sections 100 and 102 may be connected in any suitable way, as for example by welding, brazing or by being fabricated integral. Each is held against a lower corner of the seat bench by a nut 108.

By adjusting each pair of nuts 96, 98, the clamps 82 can be shifted horizontally to accommodate different depths D of the boat seat bench; and by adjusting all of these sets of nuts at both the front and back, the chair 34 can be shifted to a comfortable fore or aft position on the seat bench. When nuts 108 are tightened, the saddle members 86 automatically accommodate varying seat heights or thicknesses H.

The carriage 40 comprises a horizontal plate 110 with a pair of downturned vertical flanges 112. As best shown in FIG. 6, the carriage has, at one side, a downturned flange 114 connected between flanges 112, 112, and an inwardly extending, lower horizontal flange 116. A pair of wheels 118 are fastened by axle bolts 120 to each flange 112. As best shown in FIGS. 4 and 7, the upstanding guide rails 58 and 58*a* are positioned closely adjacent the inner sides of the wheels to keep the carriage centered between front and back walls 72 and 74. Thus, the carriage is freely movable in a straight line without dragging or rubbing the webs 52 or 52*a* of walls 72 and 74. The carriage is held against displacement upwardly by flanges 54, 54 which extend inwardly over it.

The carriage has four bolts 122 for fastening to a ball swivel bearing member 124 at the bottom of the chair 34.

As best shown in FIG. 6, the latch means 42 comprises a vertical latch pin or rod 126 which is vertically slidable in holes 128 and 130 provided in the carriage top plate 110 and flange 116 respectively. A coil spring 132 encircles the pin and is compressed between the underside of the carriage plate 110 and a cotter pin 134. An external handle 136 is readily accessible to a person sitting on the chair 34 to lift the latch against the bias of the spring.

A plurality (in this case, five) of detent openings 138 are provided in the floor plate 64 to receive the latch pin 126 and lock the carriage and chair in a selected center or offcenter position.

Use and operation are believed to be obvious in view of the above. Briefly, however, when runing the boat by means of the motor 22, the operator moves the carriage 40 and chair 34 to the side as far as possible where they will be locked in fixed position by engagement of the pin 126 in the extreme left hand detent hole 138 as shown in FIGS. 1, 2 and 3. In this position the operator can readily manipulate the motor controls and the tiller handle 30. When the boat is docked or anchorred, the operator simply pulls the pin 126 upward to release it from the detent opening and moves the carriage with the chair to the center position where the pin engages the center detent opening 138 and locks the chair in place.

While specific examples of the present invention have been shown and described for purposes of illustration, it will be apparent that changes and modifications in construction and in end use of the invention may be made without departing from its broadest aspects. For example, the invention may be employed in any application where it is desirable to mount a chair or seat for sidewise movement to different operative positions. The aim of the appended claims, therefore, is to cover all such changes, modifications and applications as fall within the true spirit and scope of the invention.

The embodiments of the invention in which an exclusive property or privilege is claimed are defined as follows:

1. An adjustable support device enabling sidewise movement of a chair along a seat bench to a plurality of fixed positions, said device comprising an elongated body, clamp means, a carriage, and latch means;

said elongated body comprising horizontally spaced front and back vertical walls adapted to be mounted on a seat bench, horizontal floor plate means interconnected between the walls at a location intermediate the tops and bottoms thereof to provide a lower space beneath the floor plate means and an upper space above the floor plate means, a pair of inwardly extending horizontal top flanges along the top edges of said walls;

said clamp means comprising a plurality of clamps each including a right-angled rod having a screwthreaded horizontal leg and a depending screwthreaded vertical leg, each said horizontal leg extending through one of said vertical walls into said lower space, each said vertical leg being positionable downwardly along a front or back edge surface of the seat bench and having at the bottom end a saddle member engageable with a lower corner of the seat bench, screw thread means acting between each horizontal leg and said body to enable individual fore-and-aft horizontal adjustment of the rods to accommodate different fore-and-aft depths of seat bench and different fore-and-aft positions of the body on the seat bench, and other screw thread means acting between the vertical legs and saddle members to accommodate vertical adjustment of the saddle members for different seat bench thicknesses;

said carriage having chair attachment means and being retained in said upper space by said flanges and being supported on said floor plate for movement between opposite sides of said body; and said latch means acting between said carriage and said body to lock said carriage in a plurality of fixed, sidewise-displaced positions.

2. An adjustable support device according to claim 1 in which said carriage has wheel means on each side bearing on respective side portions of said floor plate means, and said floor plate means has a pair of upstanding, spaced, parallel guide rails engageable with the wheel means to guide the carriage for movement without engaging said front and back vertical walls.

3. An adjustable support device according to claim 1 in which said clamp means includes at least a pair of said clamps on one of the front and back walls of the body symmetrically disposed with respect to the center of the body, and at least one of said clamps on the opposite wall ofthe body.

4. An adjustable support device according to claim 1 in which said floor plate means has a plurality of depending braces spaced inwardly from the vertical front and back walls in said lower space and aligned with the horizontal legs of said clamp rods, each said horizontal leg extending through apertures in the respective vertical wall and brace and adjustably retained therein by screw threaded connections between the horizontal legs and threaded members engaging the front and back walls, and braces, respectively.

5. An adjustable support device according to claim 1 in which opposite end walls are provided across the front and back vertical walls at the sides of the body to rigidify the body and to limit sidewise movement of the carriage within the body in both directions.

6. An adjustable support device according to claim 1 in which said latch means comprises a vertically movable pin supported on the carriage, and a plurality of detent openings in the floor plate for receiving the pin to lock the carriage in a selected, fixed position.

7. An adjustable support device according to claim 6 in which said detent openings are arranged to lock the carriage in a center position relative to the body, and at least one offcenter position on each side of the body.

* * * * *